US007004442B2

(12) United States Patent
Braungardt et al.

(10) Patent No.: US 7,004,442 B2
(45) Date of Patent: Feb. 28, 2006

(54) MOLD FRAME FOR A MOLD

(75) Inventors: Rudolf Braungardt, Pechtelsgrun (DE); Erwin Schmucker, Schelklingen (DE)

(73) Assignee: KOBRA Formen-und Anlagenbau GmbH, Lengenfeld (DE)

( * ) Notice: Subject to any disclaimer, the term of this patent is extended or adjusted under 35 U.S.C. 154(b) by 157 days.

(21) Appl. No.: 10/654,083

(22) Filed: Sep. 4, 2003

(65) Prior Publication Data

US 2004/0056171 A1 Mar. 25, 2004

Related U.S. Application Data

(63) Continuation of application No. 09/933,669, filed on Aug. 22, 2001, now abandoned.

(30) Foreign Application Priority Data

Mar. 23, 2001 (DE) ..... 101 14 398

(51) Int. Cl.
*B27B 7/00* (2006.01)

(52) U.S. Cl. ..... 249/139; 249/132; 249/165; 249/166; 249/168; 425/432

(58) Field of Classification Search ..... 249/120, 249/129, 132, 139, 160, 163, 165, 166, 168; 425/424, 432, 434

See application file for complete search history.

(56) References Cited

U.S. PATENT DOCUMENTS 895,614 A * 8/1908 Benson ..... 249/104
3,932,098 A * 1/1976 Huber et al. ..... 425/412
5,372,349 A * 12/1994 Elmore ..... 249/112
5,728,312 A * 3/1998 Van Doren ..... 249/165
5,743,510 A * 4/1998 Johnston ..... 249/155
6,007,321 A * 12/1999 Meckel et al. ..... 425/432

FOREIGN PATENT DOCUMENTS

DE 4242686 A1 * 6/1994
DE 19508152 A1 * 9/1996

OTHER PUBLICATIONS

English abstract for DE 195 08 152.*

* cited by examiner

*Primary Examiner*—Donald Heckenberg
(74) *Attorney, Agent, or Firm*—Edmund M. Jaskiewicz

(57) ABSTRACT

A mold frame for an apparatus for producing shaped concrete articles has two longitudinal and two transverse frame members which are detachably screwed to one another with form-fit on the four corners of the rectangular mold frame. The transverse frame members on their end faces have polygonal pins which fit closely into the correspondingly shaped recesses of the longitudinal frame members to resist torsional movement. The polygonal pins and recesses are penetrated by one locking screw at a time with which the mold frame is braced in itself. A mold insert which has several mold cavities is braced within the mold frame by a tongue and groove connection. The form-fit screw connection between the longitudinal and transferse frame members makes it possible to accommodate the very high forces and torques which are formed by shaking vibrations during the molding process.

4 Claims, 3 Drawing Sheets

MOLD FRAME FOR A MOLD

RELATED APPLICATION

This is a continuation application of U.S. patent application Ser. No. 09/933,669 filed Aug. 22, 2001, now abandoned.

BACKGROUND OF THE INVENTION

The present invention relates to a mold frame for an apparatus for producing shaped concrete blocks from a mold, more particularly, to such a mold frame which consists of longitudinal and transverse frame members which are connected to each other and which surround a mold insert which contains several mold cavities.

The German patent DE 195 08 152 A1 discloses a mold frame in which two longitudinal frame parts and two transverse frame parts are welded together at their ends to form the four corners of a mold frame. The outer faces of the transverse frame parts have a flange which provides a connection to a lifting frame of the molding machine. The inner faces of the mold frame are constructed as oblique surfaces in which is retained the mold insert. The outer surfaces of the mold insert have triangular prisms which contact the oblique surfaces of the mold frame when the mold insert is inserted into the welded mold frame. In order to retain the mold insert in the mold frame pressure strips are threaded from underneath onto the mold frame and adjoin with one oblique surface the bottom of the triangular prisms of the mold insert. Resilient or elastic damping pads or plates are inserted between the oblique surfaces of the mold frame and the mold insert.

During the vibration process, the mold frame with the mold insert rests upon the board of the vibrating table and is held and pressed down by the molding machine. As a result, the mold frame is subjected to high alternating stresses which often produce cracks in the welds of the frame parts and also frame factures as a result of the stresses which occur during welding. In addition, the threaded connection between the mold frame and the mold insert can become loosened or fractures may occur since the danger of fatigue fracture is increased because of the blind hole in which the screw is received and also because of the relatively short length of these mounting screws.

Generally in conjunction with a welded mold frame, weld connections are provided between the mold frame and the hardened mold insert. The resulting notch stresses lead to a significant reduction of service or operating life of the mold frame. In addition, merely providing these welded connections greatly increases the production and assembly costs of the molding operation.

It has also been proposed that the frame parts of the mold frame be threadedly connected to each other. However, this proposal has the disadvantage that as a result of shaking vibrations and the resulting torques which are transmitted only by the forces of friction within the threaded connections, a sufficient and permanent stability of the mold frame cannot be achieved. Because of the limited space conditions and the required large dimensions of the mounting screws only a single screw or threaded connection can be used at each frame corner. The torques which occur due to vibrations in the frame corners cannot be accommodated merely by the pretensioning forces of the screw and relative movements occur between the components secured by the threaded connection.

SUMMARY OF THE INVENTION

It is therefore the principal object of the present invention to provide a novel and improved mold frame for an apparatus for producing shaped concrete bodies from a mold.

It is another object of the present invention to provide such a mold frame which readily withstands the high stresses of vibration operation and facilitiates prompt replacement of the mold insert within the mold frame.

It is another object of the present invention to provide such a mold frame for enclosing a mold insert therein wherein the mold frame is simple in construction and inexpensive to construct.

The objects of the present invention are achieved and the disadvantages of the prior art as described above are overcome by the mold frame of the present invention in which the longitudinal frame parts and the transverse frame parts are detachably connected at their ends to each other with form-fitting projections provided on the corners of the mold frame.

According to one embodiment of the present invention a plurality of longitudinal and transverse frame members are connected at their ends to define a rectangular mold frame having four corners which surrounds or encloses a mold insert having one or more mold cavities therein. Means are provided at the mold frame corners for detachably connecting the longitudinal and transverse frame members together. The connecting means includes interfitting form-fit portions on the engaging ends of the longitudinal and transverse frame members.

The form-fit portions on the frame members may comprise a projection pin having a polygonal cross section on each end face of a transverse frame member. Each longitudinal frame member has on its inner face adjacent an end thereof a polygonal recess which is correspondingly shaped to closely receive the projection pin so as to avoid any twisting or torsional movement of the pin within the recess. The two frame parts are then detachably joined to each other by a locking screw.

The projection pins on the transverse frame members and the recesses on the longitudinal frame members each have a common hole therethrough which is located horizontally in the frame and this hole receives a locking screw the end of which is threadedly received within a threaded opening in the transverse frame member. The relatively long length of the locking screw greatly increases the elasticity and thus the operating and service life of the frame connection.

Preferably, the threaded hole which receives the locking screw is located in a cylindrical nut which can be loosely inserted into a correspondingly shaped opening in the transverse frame member. The threaded hole preferably extends transversely to the cylindrical axis of the cylindrical nut. Since the cylindrical nut is capable of movement within the hole any loads on the locking screw by the superimposed bending stress as a result of the oblique support of the nut are prevented.

The mold insert is retained in the mold frame by a tongue and groove connection provided on all four sides of the mold frame or only on two opposing sides of the mold insert and the mold frame. The mold insert is tensioned by the molding machine on the vibrating table so that the forces which act on the mold insert because of the shaking are damped by the tongue and groove connection and are routed to reduce stress from the mold insert to the mold frame and thus via flange strips to the molding machine.

In one modification, the tongue and groove connection between the mold frame and the mold insert may comprise a groove which is triangular in cross section and which is machined into the inner faces of the transverse and/or longitudinal frame parts. A tongue which is similarly triangular in cross section and correspondingly shaped is molded or otherwise formed on the outer faces of the mold insert so as to be closely seated within the groove.

The transfer of forces and the actions of shaking vibrations on the molding machine are additionally reduced by providing damping elements between the adjoining surfaces of the tongue and groove. These damping elements which may be in the form of resilient pads can be cemented or otherwise adhered onto the contacting surfaces of the tongues of the mold insert or can be recessed or set into the tongue surfaces.

The advantages and results which are achieved with the present invention are that the connection between the frame members of the mold frame can be heavily loaded but can still be preserved over a long period of operation. The torque forces generated by the vibrations during the molding process and also generated by pressing down on the mold insert on the vibrating table within the threaded connection between the frame members are fully accommodated by the polygonal pins and recesses which prevent the frame members from mutually twisting. the mold frame which has been screwed together in this manner has the stability of a welded frame but with the advantage of simple assembly which enables accurate positioning by means of the interfitting polygonal shaped members. Replacement of the mold insert during maintenance can be easily done by the operator by means of the quickly detachable screw or threaded connections and of the non destructive loosening of the connection between the mold frame and the mold insert. The arrangement of the damping elements within the tongue and groove connection between the mold frame and mold insert also greatly increases the efficiency of vibration since the vibrational energy remains for the most part in the mold insert. The compaction and strength of the finished concrete blocks are thus increased in this way by up to 25 percent.

BRIEF DESCRIPTION OF THE SEVERAL VIEWS OF THE DRAWING

Other objects and advantages of the present invention will be apparent upon reference to the accompanying description when taken in conjunction with the following drawings, which are exemplary, wherein.

DETAILED DESCRIPTION OF THE INVENTION

Proceeding next to the drawings wherein like reference symbols indicate the the same parts throughout the various views a specific embodiment and modifications of the present invention will be described in detail.

Figure 1:
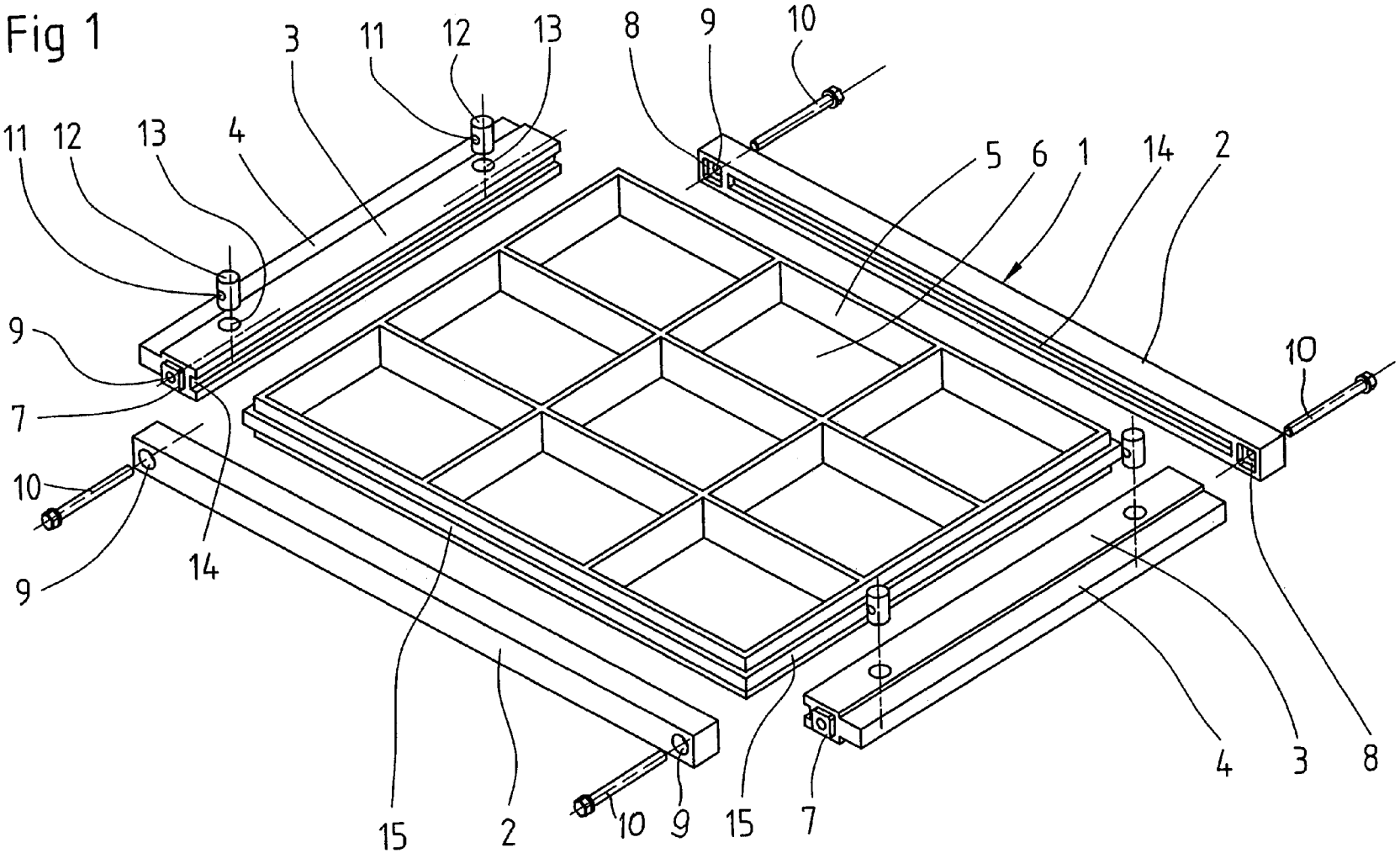
FIG. 1 is an overall perspective view of a mold frame and mold insert in the disassembled state, the mold is not shown in detail.
Figure 2:
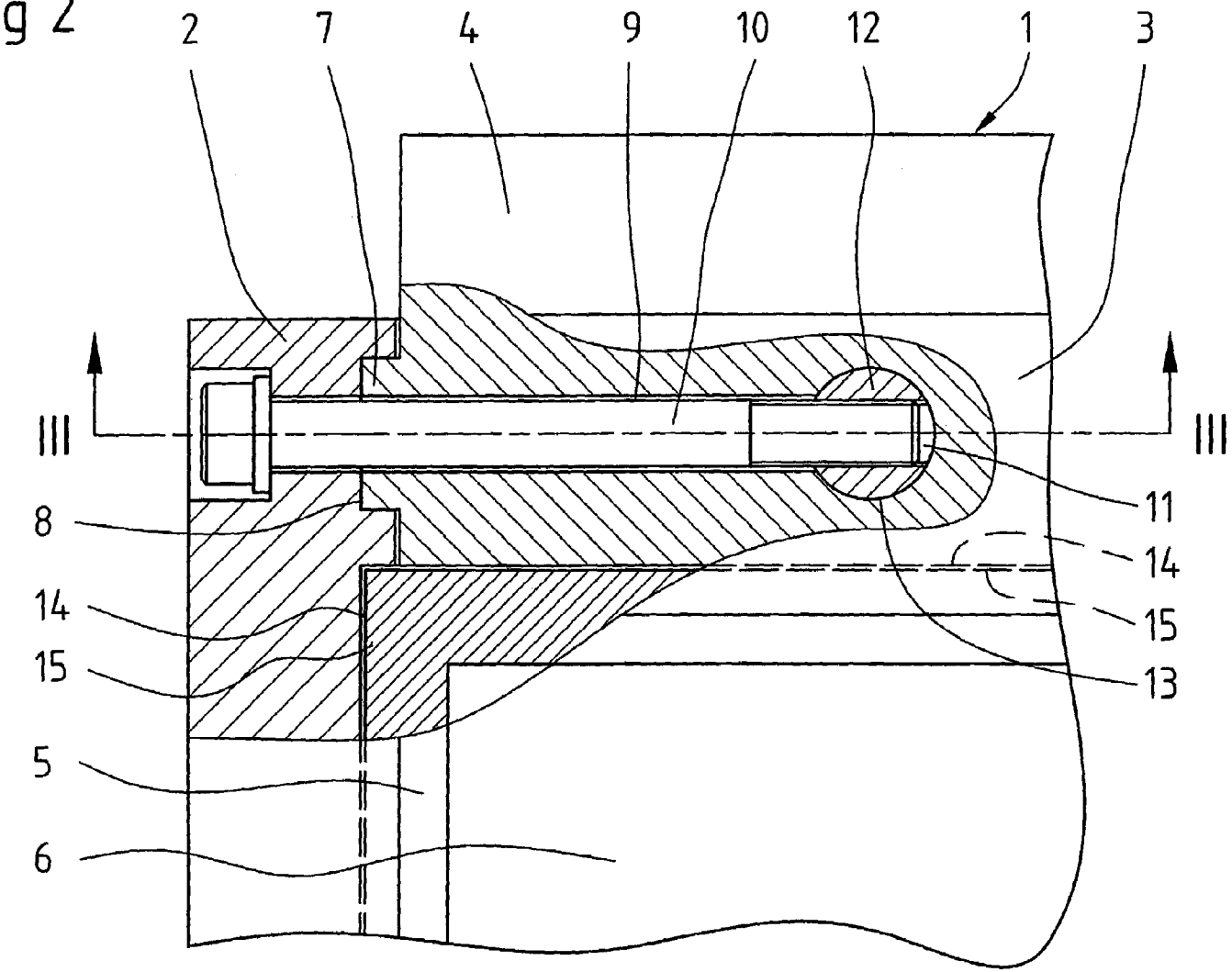
FIG. 2 is a partial top view of the connection between the frame members of the mold frame with a portion thereof partially cut away to illustrate the connection in further detail.
Figure 3:
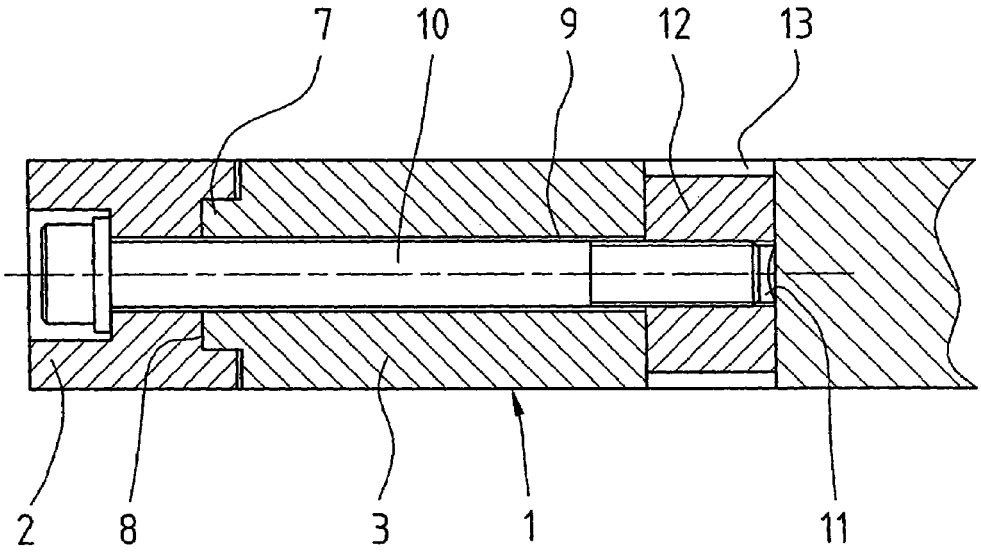
FIG. 3 is a sectional view taken along the line III—III in FIG. 2.

As may be seen in FIG. 1, a mold frame 1 of a mold which is not shown in detail for the mechanical production of a concrete block comprises two parallel longitudinal frame members 2 and two parallel transverse frame members 3 which are threadedly attached to each other on the four corners of the mold frame. Each of the transverse frame members 3 has on its outer face a flange strip 4 for attaching the mold frame 1 to the lifting frame of a molding machine which is not shown. A mold insert 5 with several mold cavities 6 is clamped into the mold frame 1. A polygonal pin 7 having a rectangular cross section is molded onto each of the two end faces of each transverse frame member 3 so as to constitute an extension of the longitudinal axis of the transverse frame member 3. A rectangular recess 8 which is correspondingly shaped to the pin 7 is milled into the inner face of the longitudinal frame member 2 adjacent each end thereof as shown in FIG. 1. In the center of the pin 7 and in the recess 8 parallel to the longitudinal axis of the transverse frame member 3 there is a through hole 9 to receive a locking screw 10. The free end of the locking screw 10 is threaded to be screwed into a threaded hole 11 of a nut 12. The nut 12 is cylindrical and is loosely inserted into a vertical hole 13 which intersects the through hole 9 at a right angle in the transverse frame member 3. The nut is pivotably mounted within the vertical hole 13 such that the locking screw 10 can fit into the threaded hole 11 which extends transversely to the cylindrical axis of the cylindrical nut 12.

In a modification, the pins 7 can also be located on the longitudinal frame members 2 and the recesses 8 can be located on the transverse frame members 3 in the reverse manner.

The inside face of each of the longitudinal and transverse frame members 2 and 3 which is facing the mold insert 5 has a continuous groove 14 to receive a correspondingly shaped tongue 15 which is located continuously on the four outer faces of the mold insert 5 and which fits into the groove 14. The tongue and groove connection 14, 15 which is formed in this manner between the mold frame 1 and the mold insert 5 is provided on all four sides of the mold frame and the mold insert. A modification is also possible in which the tongue and groove connection 14, 15 is located only on two opposite longitudinal or transverse frame members 2, 3.

When the mold frame 1 and the mold insert 5 are assembled, initially the transverse frame members 3 are connected by means of a tongue and groove connection 14, 15 on the transverse sides of the mold insert 5 to the mold insert. Subsequently, the longitudinal frame members 2 with the recesses 8 at the corner points of the mold frame 1 are slipped over the pin 7 of the transverse frame members 3 and with the grooves 14 into the tongues 15 of the mold insert 5. The pin 7 and the recesses 8 are matched to each other with a precision of fit which insures that the two parts can fit into one another virtually without play and in a torsionally strong relationship. After the longitudinal frame members 2 and the transverse frame members 3 are joined to the mold insert 5, the locking screws 10 are inserted into the common through hole 9 of the longitudinal and transverse frame members 2, 3 and are threaded into the cylindrical nuts 12. As a result, the mold frame 1 is braced torsionally and flexurally strong in itself and with the mold insert 5.

Figure 4:
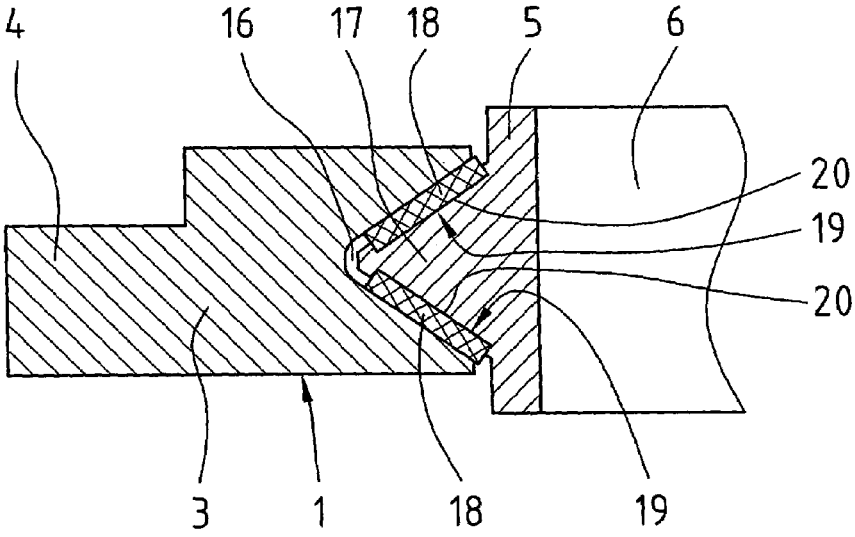
FIG. 4 is a transverse sectional view through a modification of the tongue and groove connection with damping elements between the mold frame and the mold insert.

In FIG. 4 there is shown a modification of the tongue and groove connection between the mold frame 1 and the mold insert 5. A continuous triangular groove 16 is machined into the inner face of the transverse frame members 3 and a correspondingly shaped triangular continuous tongue 17 is formed on the outer surface of the transverse sides of the mold insert 5 so as to fit into the groove. The tongue and groove connection 16, 17 can also be located on all four sides of the mold frame 1 and the mold insert 5. To damp the shaking vibrations between the tongue 17 of the mold insert 5 and the groove 16 of the mold frame 1 there are provided resilient damping pads or plates 18 which are inserted into recesses 19 formed on the contact surfaces 20 of the tongue 17. The damping plates or pads 18 can also be cemented onto the contact surfaces 20 of the tongue 17.

In a further modification, the relative positions of the tongues and grooves can be reversed by placing the grooves 14, 16 on the outer sides of the mold insert 5 and the tongues 15, 17 on the inner sides of the mold frame 1. Thus it can be seen that the present invention has disclosed a simple but effective mold frame for supporting a mold insert and which can readily withstand the many stresses and strains encountered during the molding process, especially during the vibratory stages thereof.

It will be understood that this invention is susceptible to modification in order to adapt it to different usages and conditions, and, accordingly, it is desired to comprehend such modifications within this invention as may fall within the scope of the appended claims.

What is claimed is:

1. A mold for producing shaped concrete bodies comprising a mold frame having a plurality of longitudinal and transverse frame members which are connectable at their ends to define said mold frame having four corners in order to retain a mold insert having one or more mold cavities therein, said mold insert being positionable upon a vibrating table, said transverse frame members each having an outer face directed outwardly of the mold frame, means on the outer faces of said transverse frame members for attaching to a molding machine such that said mold insert is subjected to vibrating forces perpendicular to the mold frame during the molding process, and means at said mold frame corners including interfitting form-fit portions on the ends of said longitudinal and transverse frame members for detachably connecting said longitudinal and transverse frame members together, each of said transverse frame members has a pair of end faces and there being on each end face a projection pin having a polygonal cross section, each longitudinal frame member having on its inner face a polygonal recess at each end of said inner face, said recess correspondingly shaped to receive closely said projection pin so as to avoid torsional movement of said pin within said recess, and a locking screw detachably connecting a said end face of said transverse frame member to the inner face of a said longitudinal frame member.

2. A mold as claimed in claim 1 wherein said projection pin and said recess each having a hole therethrough and aligned to receive said locking screw, and means within said transverse frame member for defining a threaded hole to receive said locking screw.

3. A mold as claimed in claim 2 wherein said means for defining a threaded hole comprises a cylindrical nut received within a hole in said transverse frame member.

4. A mold as claimed in claim 3 wherein said threaded hole is disposed transversely to the cylindrical axis of said cylindrical nut, said hole receiving said cylindrical nut extending through said transverse frame member perpendicular to the plane defined by said rectangular mold frame.

* * * * *